US005592145A

United States Patent [19]

Kellner et al.

[11] Patent Number: 5,592,145

[45] Date of Patent: Jan. 7, 1997

[54] ELECTROMAGNETIC SIGNAL HORN

[75] Inventors: Ullrich Kellner, Guetersloh; Stefan Gepfert, Lippstadt; Franz-Josef Schlueter, Erwitte; Harald Dietz, Lippstadt, all of Germany

[73] Assignee: Hella KG Hueck & Co., Lippstadt, Germany

[21] Appl. No.: 229,776

[22] Filed: Apr. 19, 1994

[30] Foreign Application Priority Data

Apr. 30, 1993 [DE] Germany ..... 43 14 242.7

[51] Int. Cl.[6] ..... G08B 3/00

[52] U.S. Cl. ..... 340/391.1; 340/388.1; 116/142 R

[58] Field of Search ..... 340/391.1, 388.1, 340/388.3, 388.4, 384.7; 180/152, 159; 116/137 R, 142 R

[56] References Cited

U.S. PATENT DOCUMENTS

| | | | |
|---|---|---|---|
| 2,301,487 | 11/1942 | White | 340/388.1 |
| 4,135,473 | 1/1979 | Frigo | 340/391.1 |
| 4,361,952 | 12/1982 | Neese | 340/391.1 |
| 4,441,099 | 4/1984 | Neese . | |
| 4,728,933 | 3/1988 | Mazza | 340/391.1 |
| 4,763,109 | 8/1988 | Smith | 340/391.1 |
| 5,270,680 | 12/1993 | Lahaye et al. | 340/391.1 |

FOREIGN PATENT DOCUMENTS

| | | | |
|---|---|---|---|
| 0446139A1 | 9/1991 | European Pat. Off. . | |
| 1566827 | 5/1969 | France | 340/388.1 |
| 1766098 | 10/1969 | Germany . | |
| 3044555A1 | 8/1981 | Germany . | |

*Primary Examiner*—Jeffery Hofsass
*Assistant Examiner*—Nina Tong
*Attorney, Agent, or Firm*—Griffin, Butler Whisenhunt & Kurtossy

[57] ABSTRACT

An electromagnetic signal horn of a type including a housing, a membrane whose peripheral edge is attached to the housing and which with the housing defines a chamber, an electromagnetic motor arranged in the chamber, and a magnetic core arranged in the chamber with an attaching pin thereof extending through a central opening of the membrane, with a coupling channel thereof, for coupling the chamber with outside atmosphere, being partially defined by a radial recess at the central opening of the membrane, wherein the central opening is four-sided, or square, for simplifying and economizing its fabrication, with a spacing between opposite sides of the central opening being the same, or only slightly larger than, a diameter of the attaching pin.

9 Claims, 3 Drawing Sheets

ELECTROMAGNETIC SIGNAL HORN

BACKGROUND OF THE INVENTION

This invention concerns an electromagnetic signal horn of a type including a housing, a membrane whose peripheral edge is attached to the housing and which with the housing defines a chamber, an electromagnetic motor arranged in the chamber, and a magnetic core arranged in the chamber with an attaching pin thereof extended through a central opening of the membrane, with a coupling channel thereof, for coupling the chamber with outside atmosphere, being partially defined by a radial recess at the central opening of the membrane.

Such a signal horn is disclosed in german publication 17 66 098. The coupling channel of this known signal horn is partially formed as a radial recess extending from a central opening of the membrane and radial slits in each of two intermediate discs, the discs respectively lying on both sides the membrane.

This known electromagnetic signal horn, however, has disadvantages. That is, when a magnetic core thereof is coupled to the membrane and the intermediate discs are mounted one must be careful that the orientations of the slits of the intermediate discs correspond to the orientation of the radial recess of the central opening of the membrane. This can only be assured, if it can be assured at all, with large fabrication expenditures.

If the above described orientations are not carefully maintained during fabrication, it is possible that the coupling channel will be blocked so that an air exchange between a chamber defined by the membrane in the housing with surrounding atmosphere cannot be assured. In this case, the disadvantages will exist in this prior art device which are particularly intended to be overcome by the device.

German Offenlegungsschrift DE 30 44 555 A1 and U.S. Pat. No. 4,441,099 describe electromagnetic signal horns which likewise have coupling channels for coupling chambers with outside atmosphere. In these known signal horns axially extending grooves are provided in attaching pins for this purpose. These known signal horns are necessarily relatively expensive to manufacture because inclusion of such a groove, or flute, in an attaching pin of the magnetic core requires additional fabrication expense, particularly if the magnetic core is forged as one piece with the attaching pin from one piece of material.

An object of this invention is to provide a signal horn which can be technically manufactured by uncomplicated and cost-effective measures to have a coupling channel for coupling the chamber with surrounding atmosphere, thereby making air exchange between the chamber and surrounding atmosphere possible.

SUMMARY OF THE INVENTION

According to principles of this invention a central opening in a membrane of an electromagnetic signal horn has a polygon shape with a minimum spacing between opposite sides forming the central opening being slightly larger than a diameter of an attaching pin of a magnetic core.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
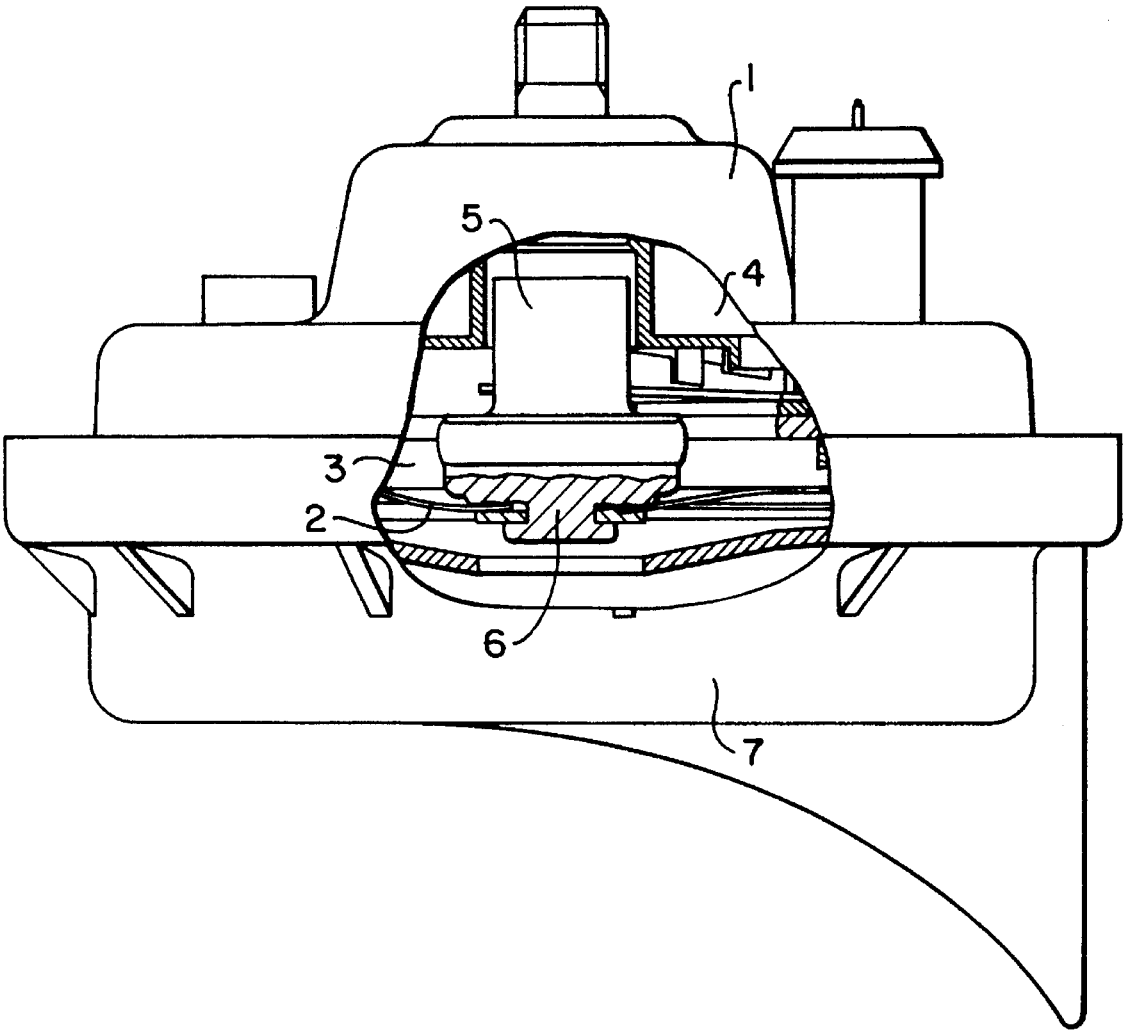
FIG. 1 is a side view of an electromagnetic signal horn of this invention formed as a trumpet, or horn, shown partially cutaway.

Referring to FIG. 1, an electromagnetic signal horn has a housing 1 which is closed by a membrane 2 so as to form a chamber 3. Within the chamber 3 an electromagnetic driver 4 is provided for pulling a magnetic core, or armature, 5 in an opening of the electromagnetic driver 4 when a coil of a electromagnetic driver 4 is energized. The magnetic core 5 has an attaching pin which protrudes through a central opening of the membrane 2.

The electromagnetic signal horn of FIG. 1 is formed as a trumpet, or horn, with a bell-mouth sound projector 7 positioned on a side of the membrane 2 away from the chamber 3.

Figure 2:
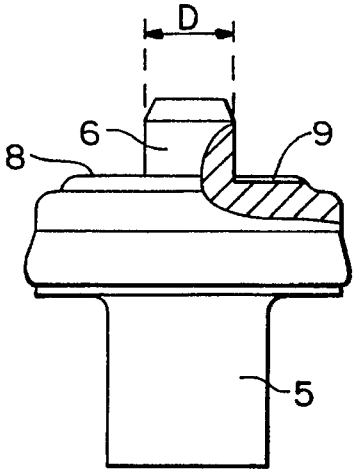
FIG. 2 is a side view of a magnetic core of the signal horn of FIG. 1, shown partially cutaway.

The same reference numerals are used in FIG. 2 to identify the same or similarly-functioning apparatus parts. One can see in FIG. 2 that the magnetic core 5, in addition to the attaching pin 6, has a membrane support surface 8 in which a groove 9, facing outwardly, is forged, or otherwise worked, to extend radially outwardly from an axis of the attaching pin 6. The attaching pin 6 has a diameter D.

Figure 3:
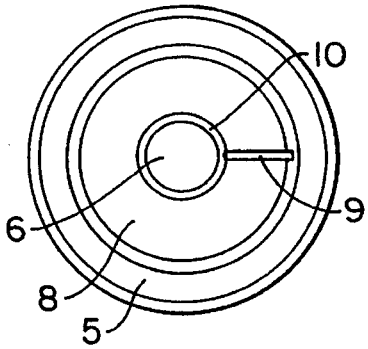
FIG. 3 is a plan view of the magnetic core of FIG. 2 showing an attaching pin thereof.

The same reference numbers are used in FIG. 3 to identify the same or similarly functioning apparatus parts as in FIG. 2. In FIG. 3 it can be seen that in addition to the radially extending groove 9 a ring canal 10 is also forged, or otherwise made, in the membrane support surface 8, adjacent the attaching pin 6.

Figure 4:
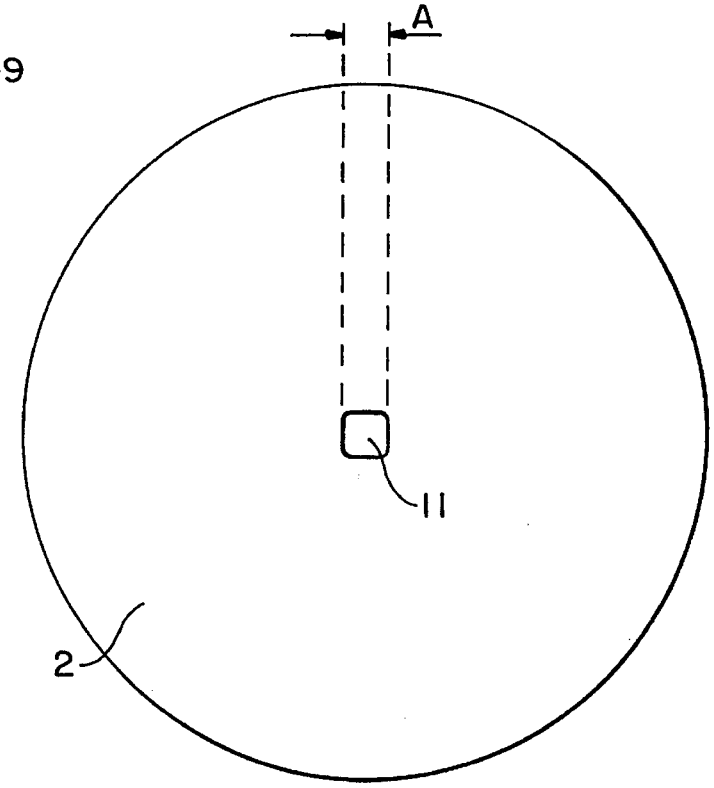
FIG. 4 is a plan view of the membrane of the electromagnetic signal horn of this invention according to FIG. 1.

In FIG. 4 it can be seen that the membrane 2 has a four-sided, or four cornered, hole, or opening, 11 that serves as a central opening for receiving the attaching pin 6 of the magnetic core 5. This four-sided opening 11 has a side edge spacing A which is about the same size, or only slightly larger than, the diameter D of the attaching pin 6 of FIG. 2 so that the sides of the four-sided opening 11 serve to center the attaching pin 6 in the openings 11 and thereby to center the magnetic core 5. The corners of the four-sided opening 11 form, together with the attaching pin 6, opposite cavities, or spaces, through which an air exchange between the chamber 3 in FIG. 1 and surrounding atmosphere of the electromagnetic signal horn is made possible.

Figure 5:
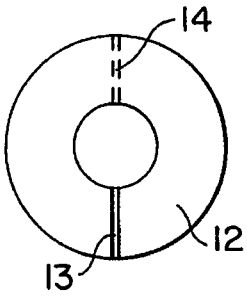
FIG. 5 is a plan view of a disc of the electromagnetic signal horn of FIG. 1.

In FIG. 5 a disc 12 is depicted which has a first further groove 13 on a depicted side thereof and a second further groove 14, represented by dashed lines, on an opposite side thereof. The first and second further grooves are angularly spaced 180 degrees from one another in order to prevent an unnecessary material weakening of the disc 12 in the areas of the grooves, which would be present if the grooves were placed directly over one another.

Figure 6:
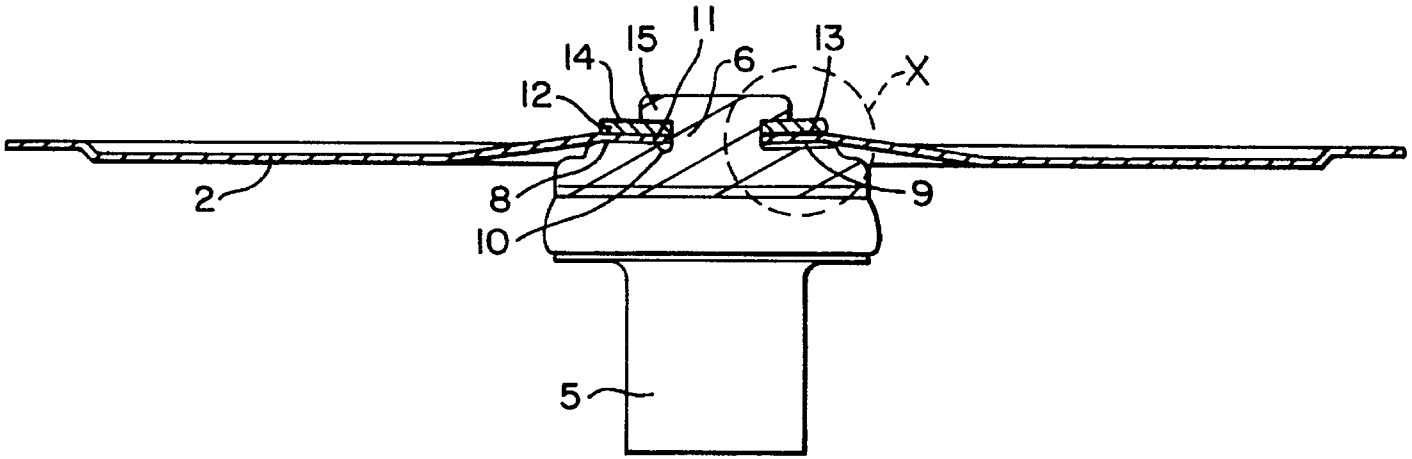
FIG. 6 is a partially cross sectional view of the magnetic core, membrane, and disc of the electromagnetic signal horn of FIG. 1 when they are assembled.

The same reference numerals are used in FIG. 6 to identify the same or similarly functioning apparatus parts as in FIGS. 1–5. One can see in FIG. 6 that the attaching pin 6 has a deformation 15 for attaching the magnetic core 5 to the disc 12 and the membrane 2. Further, the grooves 9, 13, 14, can be recognized in FIG. 6, of which grooves 9, 13, together with as edge of the four-sided opening 11 form the coupling channel to couple the chamber with surrounding atmosphere.

Figure 7:
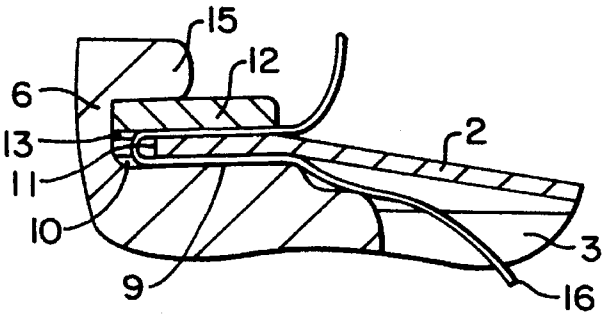
FIG. 7 is an enlarged view of a portion X of FIG. 6.

This can be seen quite easily in FIG. 7 which is an enlargement of a detail X of FIG. 6 in which an air path 16 from the chamber 3 to surrounding atmosphere, and vice versa, is represented. One can recognize in FIG. 7 that an air exchange to and from the chamber 3, via the groove 9 and the ring canal 10, through the four-sided opening 11, and via the first further groove 13 is made possible without it being necessary to particularly angularly orient the mentioned parts when they are positioned during fabrication. This represents a substantial benefit for the signal horn of this invention in comparison with those of the prior art.

Because the central opening is a many-sided hole, unlike in the prior art, during assembly of the membrane with the magnetic core the angular position of the membrane to the magnetic core can be arbitrary because in each case in every possible orientation of these two parts relative to one another an air exchange through the polygon-shaped hole (a hole bounded essentially by straight edges intersecting at corners) from the chamber to surrounding atmosphere, and in reverse, is possible.

In addition, because the polygon-shaped hole is dimensioned such that spacing between opposite side edges thereof is only slightly larger than the diameter of the attaching pin, it is guaranteed that the magnetic core is centered in the center of the membrane when it is mounted. All of these benefits are provided only because instead of using a radial, or round opening as the central hole, as in well known signal horns, the central opening is formed as a polygon, or many-sided, hole. Since such openings in membranes are normally stamped, or punched, no increased expenses for manufacturing this many-sided hole is necessary.

Fabrication of the electromagnetic signal horn of this invention, in contrast to known structures, is substantially simplified because no particular angular orientation of the parts to one another need be ascertained.

Beneficial embellishments and improvements of the signal horn of this invention are set forth herein.

Tests have shown that it is particularly beneficial to form the central opening as a four cornered (or substantially square) hole. By forming it as a square hole, on the one hand, a centering of the attaching pin in the central opening is assured. In addition, the four resulting radial cavities, or recesses, are in any case sufficient to ensure the desired air exchange.

Still further, a radial groove can be provided in a membrane-support surface of the magnetic core as a further coupling channel forming part. In this manner, contrary to known structures, a second separate disc on a side facing the magnetic core can be avoided. Since such a magnetic core can be forged together with the attaching pin of a single piece of material, the radial groove can also be forged therein during this construction step. The same is true for a ring canal, or groove, which is beneficially arranged in the membrane support surface of the magnetic core adjacent the attaching pin. This ring canal improves the air exchange from the chamber, defined by the housing and the membrane, via the radial groove to the radial cavities of the polygon-shaped hole in case that exchange, otherwise made possible through the polygon-shaped hole, is not sufficient.

On the side of the membrane facing away from the magnetic core it is particularly beneficial to provide a disc which, rather than having a slit as in prior art discs, has a radial groove, or depression. This radial groove has, contrary to a slit, the benefit that material of the disc, even in an area of the groove, is only slightly weakened which makes possible for the disc to have better dimensional stability (it does not so easily deform), even after the membrane is joined with the magnetic core. Also, the further radial groove has a fabrication benefit because this groove can be forged in an upper surface of the disc. In this regard, the disc can beneficially have a plurality of further radial grooves which are on opposite sides of the disc and which are arranged to be angularly spaced from one another. By these measures during mounting of the disc on the attaching pin, one must not be careful to correctly lay a disc side with a groove on the membrane. That is, during the mounting process, a sorting step, which is quite costly to carry out, can be avoided. This is achieved by arranging the grooves on opposite sides of the disc. By angularly spacing the grooves from one another it is avoided that the disc is even a little materially weakened and further it is provided with good size stability.

Tests have shown that, in this regard, it is sufficient if the disc has two further radial grooves which are angularly arranged 180 degrees from one another because in this manner, in each case, independently of the position of the disc on the membrane, a ventilation of the polygon hole with the environment is made possible.

It also contributes to simplification of fabrication of the electrical signal horn of this invention that the magnetic core is coupled to the membrane by means of a deformation of the attaching pin, and particularly with an intermediately positioned disc. Such a deformation is, from a manufacturing point of view, less expensive than prior art screws which tend to come loose during operation of the electromagnetic signal horn.

It is particularly beneficial that the signal horn is a trumpet with a bell-mouth downstream of the membrane. The inventive measures can, however, also be used in signal horns having no bell-mouth. With trumpets, however, the bell-mouth provides protection from a deluge of water impacting at the surrounding-environment end of the canal.

The embodiments of the invention in which an exclusive property or privilege are claimed are defined as follows:

1. An electromagnetic signal horn having a housing, a membrane whose peripheral edge is attached to the housing and which with the housing defines a chamber, an electromagnetic motor arranged in the chamber, a magnetic core, arranged in the chamber with an attaching pin thereof extending through a central opening of the membrane, with a coupling channel to couple the chamber with outside atmosphere being partially defined by a radial recess in the central opening of the membrane, wherein the central opening is a polygon-shaped hole with a spacing between opposite side edges thereof being approximately the same or only slightly larger than a diameter of the attaching pin.

2. An electromagnetic signal horn as in claim 1 wherein the central opening is approximately square.

3. An electromagnetic signal horn as in claim 1 wherein a membrane support surface of the magnetic core has a radially arranged groove therein.

4. An electromagnetic signal horn as in claim 1 wherein a membrane support surface of the magnetic core has a ring canal extending about the attaching pin.

5. An electromagnetic signal horn as in claim 1 wherein a disc is provided on the side of the membrane facing away from a main portion of the magnetic core, said disc having a further groove formed as an indentation therein.

6. An electromagnetic signal horn as in claim 5 wherein the disc has further radial grooves therein which are on opposite sides of the disc and which are angularly spaced from one another.

7. An electromagnetic signal horn as in claim 6 wherein the disc has two further radial grooves which are angularly spaced 180 degrees from one another.

8. An electromagnetic signal horn as in claim 1 wherein the magnetic core is attached to the membrane by means of a deformation of the attaching pin.

9. An electromagnetic signal horn as in claim 1 wherein the signal horn is formed as a trumpet with a bell-mouth positioned after the membrane.

* * * * *